United States Patent [19]

Deutsch et al.

[11] 4,067,254

[45] Jan. 10, 1978

[54] FREQUENCY NUMBER CONTROLLED CLOCKS

[75] Inventors: Ralph Deutsch; Leslie Joseph Deutsch, both of Sherman Oaks, Calif.

[73] Assignee: Deutsch Research Laboratories, Ltd., Sherman Oaks, Calif.

[21] Appl. No.: 634,533

[22] Filed: Nov. 24, 1975

[51] Int. Cl.[2] ..... G10H 1/00

[52] U.S. Cl. ..... 84/101; 84/1.22

[58] Field of Search ..... 84/1.01, 1.03, 1.11, 84/1.19, 1.21, 1.22

[56] References Cited

U.S. PATENT DOCUMENTS

| | | | |
|---|---|---|---|
| 3,659,031 | 7/1972 | Adachi | 85/1.19 |
| 3,719,767 | 3/1973 | Matumoto | 84/1.01 |
| 3,781,450 | 12/1973 | Nakajima | 84/1.01 |
| 3,821,712 | 6/1974 | Wetzel | 85/1.01 |
| 3,836,692 | 9/1974 | Nakajima | 84/1.01 |

*Primary Examiner*—Robert K. Schaefer
*Assistant Examiner*—Vit W. Miska
*Attorney, Agent, or Firm*—Ralph Deutsch

[57] ABSTRACT

In a musical polyphonic tone synthesizer, musical waveshapes are produced by voltage controlled oscillators. The analog frequency control voltages are created by converting stored digital numbers to analog voltages. The selection of these digital numbers and their assignment to a plurality of voltage controlled oscillators is controlled by detecting switches actuated on a keyboard. Provision is made for operating the oscillators over the full frequency range of an electronic musical instrument's keyboard. Automatic tuning means is incorporated to adjust the conversion reference voltage for each oscillator to keep the musical instrument in tune by locking the set of voltage controlled oscillators to a stable reference oscillator. Tuning the reference oscillator thereby tunes the set of voltage controlled oscillators while retaining equal tempered musical frequencies.

19 Claims, 14 Drawing Figures

FREQUENCY NUMBER CONTROLLED CLOCKS

BACKGROUND OF THE INVENTION

1. Field of the Invention

The present invention relates to the use of voltage controlled oscillators in a polyphonic tone synthesizer musical instrument.

2. Related Applications

This invention is related to the inventors' copending U.S. patent application Ser. No. 619,615 filed on Oct. 6, 1975 entitled KEYBOARD SWITCH DETECT AND ASSIGNOR and to their copending U.S. patent application Ser. No. 603,776 filed on Aug. 11, 1975 entitled POLYPHONIC TONE SYNTHESIZER.

3. Description of the Prior Art

In electronic musical keyboard instruments of the tone synthesizer variety it has been found to be advantageous to use voltage controlled oscillators for the frequency determining elements of the tone synthesizer. These oscillators generally operate in such a manner that their generated frequency is a linear, or essentially linear, function of the control function. For generating the frequencies of the normal equal tempered musical scale, a linear relation between the voltage and frequency is not desirable; an exponential relation is required and is obtained by means such as that shown in FIG. 10.

In FIG. 10, twelve resistors $R_1$ through $R_{12}$ and switch contacts 1 through 12 are arranged such that the reference voltage is divided into twelve equal parts. Actuating a key contact on the musical instrument's keyboard produces a voltage input to Linear Adder 201 which is a linear function of the twelve notes within a musical octave. A second input, $E_2$, is provided to Linear Adder 201 to introduce various frequency modulation effects such as vibrato and portomento. The sum of the input voltages $E_0 = E_1 + E_2$ is applied to Exponential Convertor 202 to obtain the control signal voltage $V = A \exp(BE_0)$. V is then used as a control signal for Voltage Controlled Oscillator 203 which generates a repetitive signal at the frequency $f = KV$, where K is a constant.

There are several practical limitations to the arrangement shown in FIG. 10 which require rather expensive circuit components and design complexity. The output frequency will vary with any change in the reference voltage. Therefore a precision regulated reference voltage source is required which is invariant with nominal fluctuations in power line voltages and with changes in the ambient temperature. The voltage controlled oscillator must by carefully designed with temperature compensating circuit elements to prevent temperature induced frequency drifts. A third source of frequency error is sometimes caused by the exponential convertor which must be precisely designed to provide the required exponential transfer characteristic over the operating range.

Although it is possible to design voltage controlled oscillators of the type shown in FIG. 10 which cover the five octaves of an electronic organ's keyboard range, it has been generally found that the better procedure is to design for a single octave and to switch new frequency determining component values for each of the five octaves. When octave switching of components in the oscillator is mechanized, a second keyboard contact switch is connected to each key so that octave switching information is generated.

Voltage controlled oscillators exhibit limitations when either the tone synthesizer is an integral part of a companion musical instrument such as an electronic organ or when a polyphonic tone synthesizer contains a plurality of voltage controlled oscillators. These limitations arise from the necessity of maintaining a precision of tuning pitch without having to continuously adjust tuning controls.

The present invention is particularly advantageous for use in an electronic musical instrument of the type described in the inventor's copending U.S. patent application Ser. No. 603,776 entitled POLYPHONIC TONE SYNTHESIZER.

Objects of the present invention include i. frequency control of a plurality of voltage controlled oscillators
ii. assignment in a musical tone generator of a plurality of voltage controlled oscillators less than the number of keys on the keyboard
iii. automatic tuning controlled by a single reference oscillator
iv. frequency ratios controlled by stored table of numbers
v. economical mechanization by utilizing a plurality of voltage controlled oscillators which time share common control channels.

Other objects and features of the invention will become apparent in conjunction with the following descriptions and drawings.

SUMMARY OF THE INVENTION

The foregoing objectives are achieved by storing the frequency assignments of a plurality of voltage controlled oscillators in a read/write memory in the form of assignment data words. The assignment data words use the LSB (Least Significant Bit) to denote assignment status. A zero LSB indicates an unassigned status for the corresponding oscillator. The identity of a particular oscillator is either contained as part of the data word or is under control of central executive logic which associates the address of an assignment data word with each oscillator in the set of oscillators.

The assignment data word, in addition to the LSB which denotes assignment status, contains information that is decoded to address frequency data words from a frequency number table. The address frequency data words are converted to analog frequency control signals by means of a digital-to-analog convertor. Means are provided to store either the frequency data word or the analog frequency control signal so that a single time shared data conversion channel can be used for the set of oscillators.

The subject invention is applicable to musical tone generating systems. It is advantageously used in the POLYPHONIC TONE SYNTHESIZER (U.S. patent application Ser. No. 603,776). In this system, each key actuated on an electronic musical instrument is detected and identifying data and key assignment status is stored in a read/write assignment memory. In addition to the assignment status, the data word identifies the actuated key by the octave number and musical note within an octave.

The present invention includes means for extending the frequency range of the set of voltage controlled oscillators by using a table of frequency numbers for only a single octave and employing the associated octave data to switch sets of frequency determining circuit elements designed for each octave into the circuitry of each such oscillator.

Vibrato and other frequency modulation effects are obtained by arithmetical operations on the frequency data numbers before they are converted to analog frequency control voltages.

An automatic frequency tuning means is included which causes the set of voltage controlled oscillators to be repetitively tuned to a single reference frequency as provided by a reference oscillator. Tuning adjustments are automatically programmed when power is first applied to the musical instrument containing the subject invention and during such instants during use wherein particular voltage oscillators have been detected to be in an unassigned state and are thereby available for tuning corrections. Memory means are provided to retain tuning corrections between the tuning intervals for each individual oscillator.

BRIEF DESCRIPTION OF THE DRAWINGS

A detailed description of the invention will be made with reference to the accompanying drawings wherein like numerals designate like components in the several figures.

DESCRIPTION OF THE PREFERRED EMBODIMENT

The following detailed description is of the best presently contemplated modes of carrying out the invention. This description is not to be taken in a limiting sense, but is made merely for the purpose of illustrating the general principles of the invention since the scope of the invention is best defined by the appended claims. Structural and operational characteristics attributed to forms of the invention first described shall also be attributed to forms later described, unless such characteristics are obviously inapplicable or unless specific exception is made.

Figure 1:
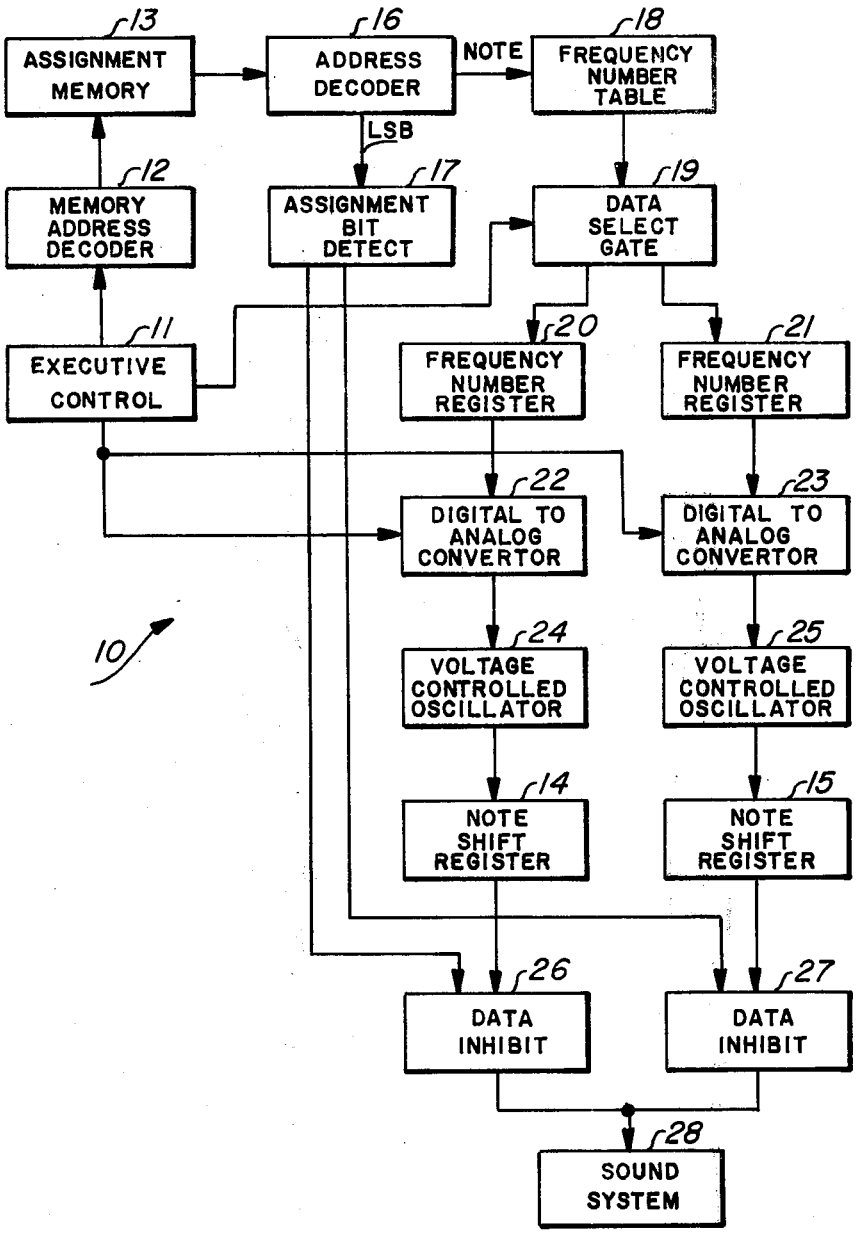
FIG. 1 is a block diagram of the frequency number clocks as used with the polyphonic tone synthesizer.

FIG. 1 illustrates the logic block diagram for the Frequency Number Controlled Clocks in a system configuration 10 advantageous for utilization in a musical sound generation system such as that described in the copending application POLYPHONIC TONE SYNTHESIZER, Document Ser. No. 603,776.

Executive Control 11 cyclically and repetitively generates control signals which are furnished to Memory Address Decoder 12. Memory Address Decoder 12 transforms the signals received from Executive Control 11 into a form which causes corresponding data words to be read from Assignment Memory 13.

Assignment Memory 13 is a read/write memory which may be a RAM (Random Access Memory) or may advantageously be a shift register operating in an "end-around" read out mode. For a musical sound generation system such as the POLYPHONIC TONE SYNTHESIZER herein used for illustration purposes, the data words contained in Assignment Memory 13 consist of 1 bit (LSB) to indicate assigned or unassigned status of a corresponding voltage controlled oscillator; 2 bits denote the musical instrument's division and is used to select the particular data written into Note Shift Registers 14 and 15; 3 bits denote the octave on the musical instrument's keyboard; 4 bits denote the musical note within an octave.

Address Decoder 16 operates on the data read from Assignment Memory 13 to channel the LSB to Assignment Bit Detect 17 and to decode the bits denoting the note in the octane in a form suitable for addressing data stored in Frequency Number Table 18.

Frequency Number Table 18 is a ROM (Read Only Memory) containing frequency data words in binary form. These data words are the values of $2^{-(n/12)}$; $n = 1,2,\ldots,M$ and as such represent the ratios of frequencies in an equal-tempered musical scale. M is the number of keys on the musical instrument's keyboard. While Frequency Number Table 18 is advantageously a ROM, it is an obvious extension to use a RAM (Random Access Memory) so that new frequency data words can readily be introduced when it is desired to generate clock frequencies which do not correspond to the equal-tempered musical scale but which may correspond to any other desired set of frequencies.

The frequency data words read from Frequency Number Table 18 are directed by means of Data Select Gate 19 to either Frequency Number Register 20 or Frequency Number Register 21. The selection of the particular Frequency Number Register is accomplished in response to a control signal generated by Executive Control 11 and furnished to Data Select Gate 19.

The Frequency Number Registers 20 and 21 hold the frequency data words read from Frequency Number Table 18 and serve as a temporary memory to store these data until such time as a change is directed by Executive Control 11.

The frequency data words are converted to analog frequency control voltages by means of Digital to Analog Convertor 22 and Digital to Analog Convertor 23. The analog frequency voltages are furnished respectively as frequency control signals to Voltage Controlled Oscillator 24 and Voltage Controlled Oscillator 25. Advantageously the Voltage Controlled Oscillators are oscillators such that their generated frequencies are linear, or closely linear approximations, functions of their input analog frequency control voltages.

Each Voltage Controlled Oscillator comprises some means for temporary analog voltage storage capability, such as a conventional sample-and-hold subsystem whereby the analog voltage received from the corresponding Digital to Analog Convertor is retained between conversion cycles. The conversion cycles are initiated by Executive Control 11 and are timed such that conversions take place sufficiently often to permit the analog voltage storage subsystem to maintain an essentially constant voltage.

The Voltage Controlled Oscillators 24 and 25 as used in the POLYPHONIC TONE SYNTHESIZER (Document Ser. No. 603,776) serve as Note Clocks to address and cause data to be read out from Note Shift Register 14 and Note Shift Register 15. Data Inhibit 26 and Data Inhibit 27 act to inhibit data read from the corresponding Note Shift Registers from reaching Sound System 28 unless the assignment bit detected by Assignment Bit Detect 17 indicates that the corresponding Voltage Controlled Oscillator has been directed to operate at a frequency corresponding to an assigned switch on the musical instrument's key board.

The frequency data words contained in Frequency Number Table 18 are shown in Table 1 for the equal-tempered musical scale. The number of bits in each frequency data words is chosen as a compromise between the desired frequency accuracy and the practical problem of building a Digital to Analog Convertor capable of accurately converting a large number of bits. The first column of Table 1 lists the notes of the conventional musical keyboard for an organ; the second column lists the corresponding musical frequencies of the fundamental frequency; the third column lists the ratio R of a note's frequency to that of C#7 which is chosen to have the value of one; the fourth column lists R as a 16 bit binary number; the fifth column lists the frequency error in cents caused by limiting R to 16 bits; and the sixth column lists the frequency error in cents caused by limiting R to 10 bits. C#7 is selected to have unity value so that, as described later in connection with a means for vibrato, numbers can be added to the binary number corresponding to the top note C7 without exceeding a binary number represented by all bits having a value of "1".

TABLE 1

| NOTE | FREQ. | R | R-BINARY | 16 BIT CENT ERROR | 10 BIT CENT ERROR |
|---|---|---|---|---|---|
| C7 | 2093,0 | 0.9438743127 | 1 1 1 1 0 0 0 1 1 0 1 0 0 0 1 0 | −0.007 | −0.846 |
| B6 | 1975.0 | 0.8908987182 | 1 1 1 0 0 1 0 0 0 0 0 1 0 0 1 0 | −0.002 | 0.532 |
| A#6 | 1644.7 | 0.8408964153 | 1 1 0 1 0 1 1 1 0 1 0 0 1 0 1 | −0.004 | 0.157 |
| A6 | 1760.0 | 0.7937005260 | 1 1 0 0 1 0 1 1 0 0 1 1 0 0 0 0 | −0.002 | −0.534 |
| G#6 | 1661.2 | 0.7491535385 | 1 0 1 1 1 1 1 1 1 1 0 0 1 0 0 1 | −0.017 | 0.301 |
| G6 | 1568.0 | 0.7071067813 | 1 0 1 1 0 1 0 1 0 0 0 0 0 1 0 1 | −0.002 | 0.185 |
| F#6 | 1480.0 | 0.6674199272 | 1 0 1 0 1 0 1 0 1 1 0 1 1 1 0 0 | 0.001 | 1.110 |
| F6 | 1396.9 | 0.6299605251 | 1 0 1 0 0 0 0 1 0 1 0 0 0 1 0 1 | 0.004 | 0.214 |
| E6 | 1318.5 | 0.5946035577 | 1 0 0 1 1 0 0 0 0 0 1 1 1 0 0 0 | −0.003 | −0.358 |
| D#6 | 1244.5 | 0.5612310244 | 1 0 0 0 1 1 1 1 1 0 1 0 1 1 0 1 | −0.008 | −0.902 |
| D6 | 1174.7 | 0.5297315474 | 1 0 0 0 0 1 1 1 1 0 0 1 1 1 0 0 | 0.023 | 1.421 |
| C#6 | 1108.7 | 0.5000000000 | 1 0 0 0 0 0 0 0 0 0 0 0 0 0 0 0 | 0.000 | 0.000 |
| C6 | 1046.5 | 0.4719371584 | 0 1 1 1 1 0 0 0 1 1 0 1 0 0 0 1 | 0.007 | −0.945 |
| C3 | 130.8 | 0.0589921445 | 0 0 0 0 1 1 1 1 0 0 0 1 1 0 1 1 | −0.406 | 11.731 |
| B2 | 123.5 | 0.0556811698 | 0 0 0 0 1 1 1 0 0 1 0 0 0 0 0 1 | 0.057 | 0.532 |
| A#2 | 116.5 | 0.0525560259 | 0 0 0 0 1 1 0 1 0 1 1 1 0 1 0 0 | 0.149 | −5.865 |
| A2 | 110.0 | 0.0496062828 | 0 0 0 0 1 1 0 0 1 0 1 1 0 0 1 0 | 0.523 | −6.910 |
| G#2 | 103.8 | 0.0468220961 | 0 0 0 0 1 0 1 1 1 1 1 1 1 1 0 1 | −0.272 | −1.955 |
| G2 | 98.0 | 0.0441941738 | 0 0 0 0 1 0 1 1 0 1 0 1 0 0 0 0 | 0.176 | 9.776 |
| F#2 | 92.5 | 0.0417137454 | 0 0 0 0 1 0 1 0 1 0 1 0 1 1 1 0 | −0.157 | −11.518 |
| F2 | 87.3 | 0.0393725328 | 0 0 0 0 1 0 1 0 0 0 0 1 0 1 0 0 | 0.203 | 13.866 |
| E2 | 82.4 | 0.0371627223 | 0 0 0 0 1 0 0 1 1 0 0 0 0 1 1 | 0.353 | 2.487 |
| D#2 | 77.8 | 0.0350769390 | 0 0 0 0 1 0 0 0 1 1 1 1 1 0 1 1 | −0.161 | −3.910 |
| D2 | 73.4 | 0.0331082217 | 0 0 0 0 1 0 0 0 1 0 1 1 1 0 1 0 | −0.188 | −4.955 |
| C#2 | 69.3 | 0.0312500000 | 0 0 0 0 1 0 0 0 0 0 0 0 0 0 0 0 | 0.000 | 0.000 |
| C2 | 63.4 | 0.0294960723 | 0 0 0 0 0 1 1 1 1 0 0 1 1 0 1 | 0.049 | −11.731 |

Table 1 is limited to entries in only octave 6 and octave 2, plus C7. For many musical instruments a frequency error of less than 3 cents is considered adequate for most purposes. An examination of the entries in Table 1 indicates that frequency data words consisting of 16 bits are adequate for the entire keyboard range. However, 10 bit frequency data words are not adequate for octave 2. The reason for the inadequacy is that the first four significant bits of information are right shifted in octave 2 so that the number of significant bits has essentially been reduced by four. The subject invention is extended as described in later paragraphs to overcome the apparent frequency error resulting from using restricted frequency data word bit lengths by using octave division subsystems.

Figure 2A:
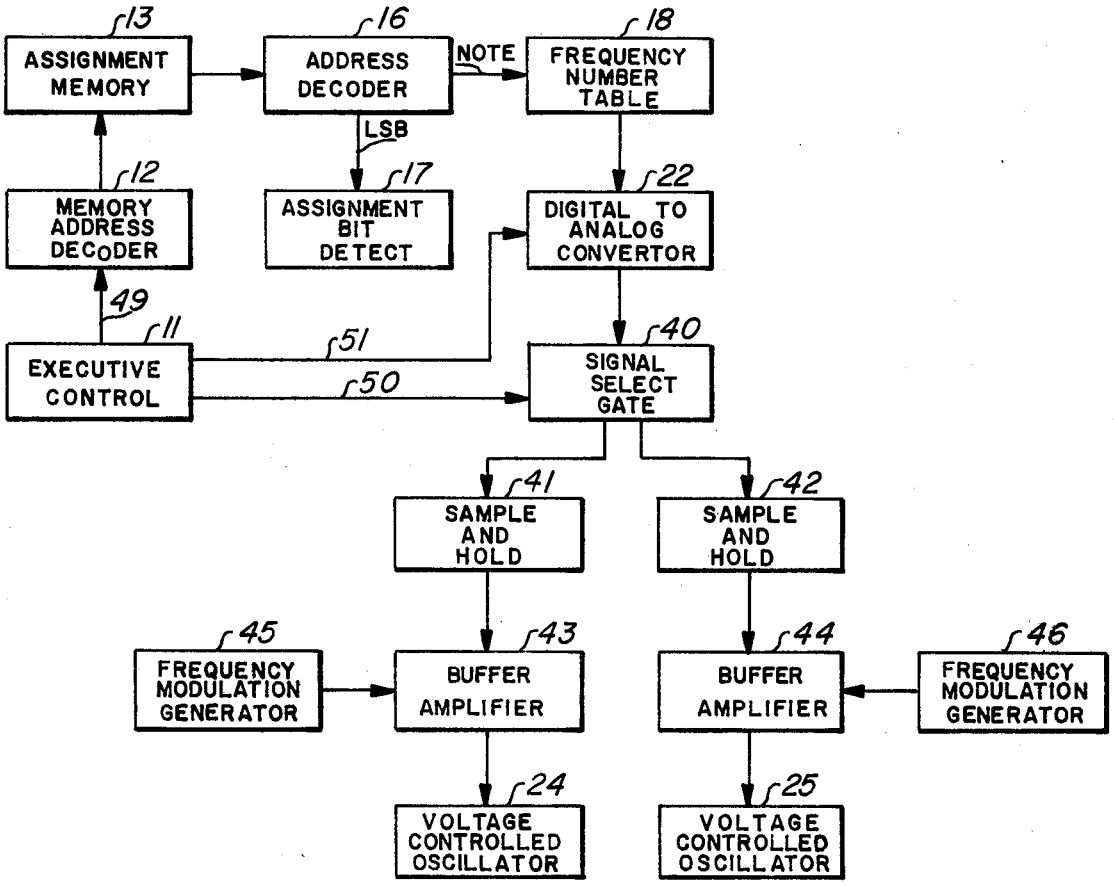
FIG. 2*a* is a block diagram illustrating a time shared data conversion channel and frequency control voltage memory.

FIG. 2*a* shows a modification of system 10 shown in FIG. 1, and previously described, wherein only a single Digital to Analog Convertor is required. The single Digital to Analog Convertor is time shared to convert all the frequency data words for each of the available Voltage Controlled Oscillators. All the required timing functions and clock pulses are generated within the logic system block labeled Executive Control 11. Three such control lines, 49, 50, and 51 are shown explicitly in FIG. 2*a*. The remainder have been omitted for clarity in the drawing.

As each frequency data word is read from Frequency Number Table 18, the binary data is converted to an analog voltage by means of Digital to Analog Convertor 22. The timing of the conversion is controlled by Executive Control 11 as indicated by line 51 in FIG. 2*b*. After conversion, the analog voltage corresponding to an input frequency data word is caused by Signal Select Gate 40 to be directed to either Sample and Hold 41 or Sample and Hold 42. The selection of the proper sample and hold is determined by signals transmitted from Executive Control 11.

The output of each sample and hold is connected to a buffer amplifier, 43 and 44. The sample and hold circuits serve as a memory for the analog voltages which control the frequency of the voltage controlled oscillators, 24 and 25. The buffer amplifiers, 43 and 44, have a second input signal port through which a wide variety of frequency modulating signals can be introduced to be added to the basic frequency control signal. These modulating signals are shown as being created by Frequency Modulation Generator 45 and Frequency Modulation Generator 46. The resulting output signal from each buffer amplifier is used as a frequency control signal for the Voltage Controlled Oscillators, 24 and 25.

The Frequency Modulation Generators can be used to introduce a variety of frequency tonal effects such as vibrato, glide, portomento, and random noise frequency variations.

Figure 2B:
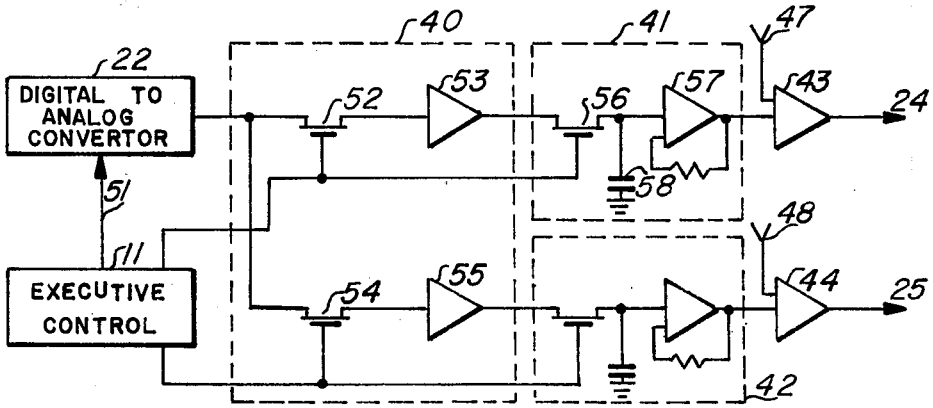
FIG. 2*b* shows the logic diagram of the sample and hold circuits time shared with a digital to analog convertor.

FIG. 2*b* illustrates some of the circuitry associated with logic blocks contained in FIG. 2*a*. Signal Select Gate 40 consists of MOS FET switches 52 and 54 which permit signals to reach operational amplifiers 53 and 55 when placed in conducting states by means of signals created within Executive Control 11. Sample and Hold 41 contains a MOS FET switch 56 controlled by Executive Logic 11. Switch 56 is caused to conduct and charge capacitor 58 after the completion of a digital to analog conversion by Digital to Analog Convertor 22. Operational Amplifier 57 transfers the voltage contained on capacitor 58 to Buffer Amplifier 43 without discharging the capacitor.

Figure 3:
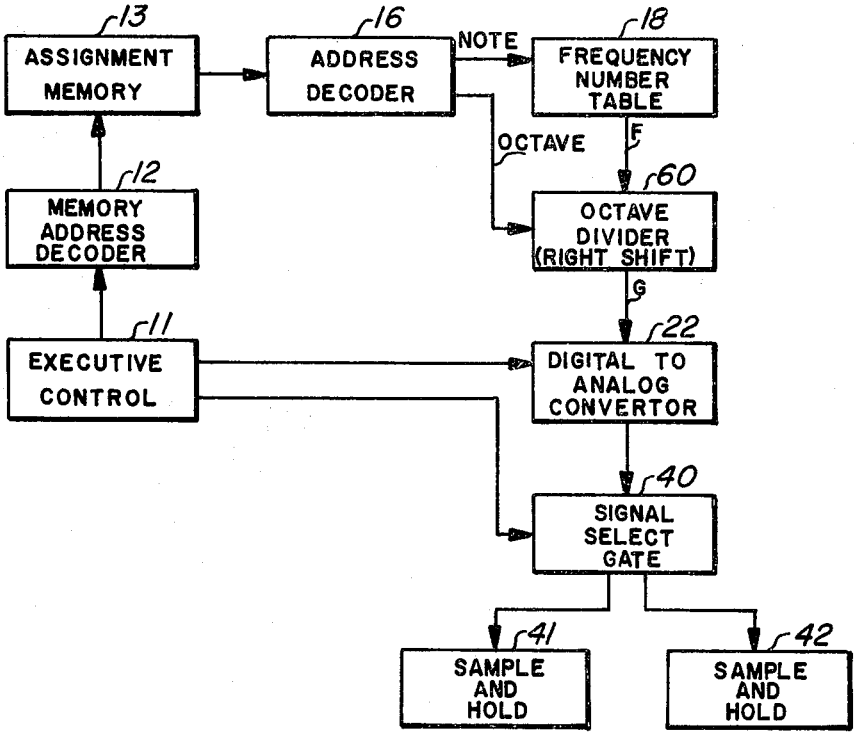
FIG. 3 is a block diagram showing the use of a single octave table of frequency numbers and an octave divider.

FIG. 3 illustrates an alternate configuration of the form of the subject invention shown in FIG. 2*a*. The alternate configuration utilizes a frequency number table consisting of thirteen frequency data words corresponding to the thirteen musical notes $C_7$, $B_6$, $A\#_6$, $A_6$, $G\#_6$, $G_6$, $F\#_6$, $F_6$, $E_6$, $D\#_6$, $D_6$, $C\#_6$, $C_6$. The thirteenth note $C_7$ is used so that an additional divide by two circuit is not required in Octave Divider 60. It is obvious that the frequency table may comprise 12 frequency data words by allowing for an appropriate number for octave division in Octave Divider 60.

Address Decoder 16 is used to decode only the note within an octave and to address the data word corresponding to the note from Frequency Number Table 18. Address Decoder 16 also causes the octave data bits confined in data words stored in assignment Memory 13 to be tranferred to Octave Divider 60. Octave Divider 60 divides the frequency data words by powers of two by shifting the binary data words to the right as required by the octave control signal. Thus notes called for in octave 5, cause a right shift of one position or a division by 2. Table 2 shows the right shifts required for each octave in an organ. The octave divisions correspond to divisions by a factor $2^{(6-M)}$, where M is the octave number, and $C_7$ is not included in top octave. If $C_7$ to $C\#_6$ constitutes the top octave, then the divisor used in $2^{(7-M)}$.

Figure 4:
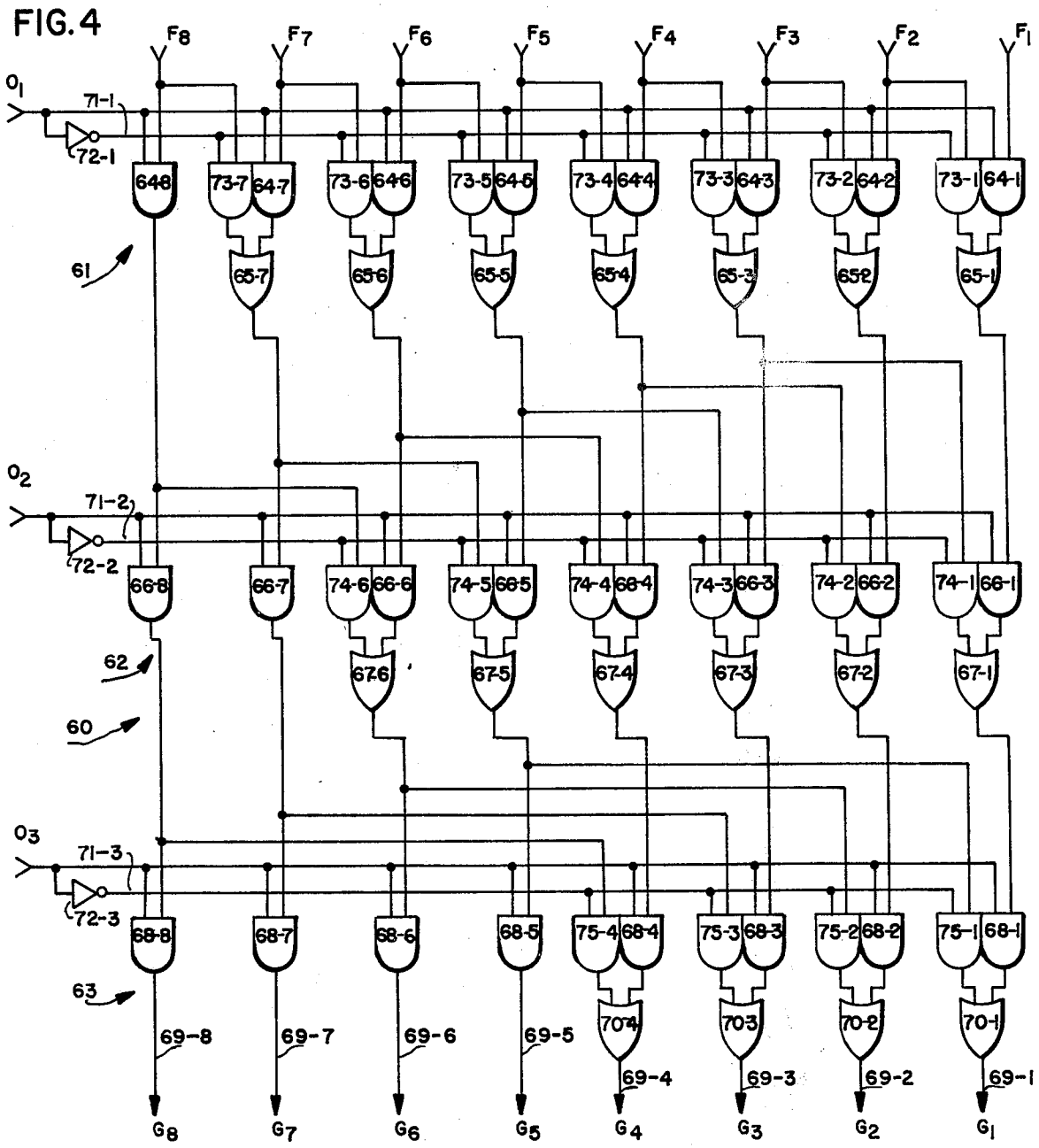
FIG. 4 shows the logic diagram of an octave divider.
Figure 10:
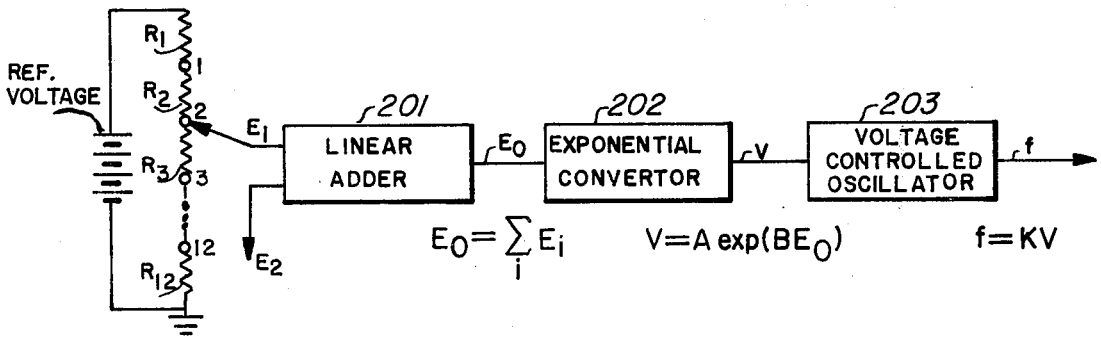
FIG. 10 shows the conventional use of voltage controlled oscillators in musical instrument tone generating systems.

A logic diagram for a subsystem which can be utilized to implement Octave Divider 60 is shown in FIG. 4. For illustrative purposes, the frequency data word is represented by bits $F_1$ to $F_8$, wherein $F_1$ is the least significant bit. Bits $G_1$ to $G_8$ represent the output frequency data word from Octave Divider 60. Bits $O_1$, $O_2$, $O_3$ represent the octave data stored in Assignment Memory 13 and transferred to Octave Divider 60 by means of Address Decoder 16.

TABLE 2

| OCTAVE | FREQUENCY DIVISION | RIGHT SHIFT IN BIT POSITION |
|---|---|---|
| 7 | 0 | 0 |
| 6 | 0 | 0 |
| 5 | 2 | 1 |
| 4 | 4 | 2 |
| 3 | 8 | 3 |
| 2 | 16 | 4 |

The right shifting of the frequency data words is accomplished by a first set of logic gates 61 associated with octave bit $O_1$, a second set of logic gates 62 associated with octave bit $O_2$, and a third set of logic gates 63 associated with octave bit $O_3$. The logic gates 61 introduce a right shift of one bit position if the $O_1$ bit is 0 and introduce no shift if $O_1 = 1$. The logic gates 62 cause a right shift of two bit positions if $O_2 = 0$ and introduce no shift if $O_2 = 1$. The logic gates 63 introduce a shift of four places if $O_3 = 0$ and introduce no shift if $O_3 = 1$. For brevity, FIG. 4 is drawn for frequency data words consisting of 8 bits. The extension to any number of bits is apparent by replicating the sets of logic gates.

The logic 61 includes a first set of AND gates 64-1 through 64-8 which are enabled when $O_1 = 1$. When so enabled, these gates transfer the respective bits $F_1$ through $F_8$ via respective OR gates 65-1 through 65-7 to a set of AND gates 66-1 through 66-7 in the logic 62. The output from 64-8 is connected directly to gate 66-8 without a corresponding OR gate. These AND gates 66-1 through 66-8 likewise are enabled when $O_2 = 1$. The signals from these enabled gates are supplied directly and via respective OR gates 67-1 through 67-6 to the corresponding AND gates 68-1 through 68-8 in the logic 63. Again, these AND gates 68-1 through 68-8 are enabled when $O_3 = 1$. The output of the AND gates 68-1 through 68-8 are supplied directly and via OR gates 70-1 through 70-4 to the respective output lines 69-1 through 69-8 corresponding to the respective output bits $G_1$ through $G_1$ of the octave divided frequency number data.

In this manner, it can be seen that if $O_1$, $O_2$, and $O_3$ are all 1, then no shift of the frequency data word F occurs. That is, the data bit $F_1$ through $F_8$ are supplied directly to the corresponding output lines 69-1 through 69-8.

If $O_1 = 0$ and $O_2$ and $O_3$ are both 1, a right shift of one place occurs in the subsystem logic 60. This is accomplished since the $O_1 = 0$ signal on line 71-1, after inversion by 72-1 enables a set of AND gates 73-1 through 73-7 which gate the respective data bits $F_2$ through $F_8$ to the respective OR gates 65-1 through 65-7. From there the signals are communicated as described above to the respective output lines 69-1 through 69-8. The input bit $F_2$ appears as the $G_1$ output, and the $F_8$ input bit appears as the $G_7$ output. The desired right shift of the one bit position is accomplished.

If $O_1 = 1$, $O_2 = 0$, $O_3 = 1$, the subsystem 60 performs a right shift of two bit positions. To accomplish this shift, the $O_2 = 0$ signal, after inversion by 72-2 enables a set of AND gates 74-1 through 74-6. The enabled AND gates 74-1 through 74-6 pass the signals from the respective OR gates 65-1 through 65-7 to the respective OR gates 67-1 through 67-6. Since both $O_1 = 1$ and $O_3 = 1$, no shift occurs in the logic 61 or 63. Therefore, with $O_2 = 0$, the $F_3$ input bit is supplied to the output line 69-1 as bit $G_1$. Similarly, the other bits $F_4$ through $F_8$ are shifted two bit places to the right and appear as the output bits $G_2$ through $G_6$ respectively. The output of $G_7$ and $G_8$ are both zero.

A right shift of four places occurs when $O_1 = 1$, $O_2 = 1$, $O_3 = 0$. In this situation, the $O_3$ signal after inversion by 72-3, enables a set of AND gates 75-1 through 75-4. The enabled AND gates 75-1 through 75-4 supply the outputs of the OR gates 67-5 and 67-6 and the outputs of the AND gates 66-7 and 66-8 via the OR gates 70-1 through 70-4 to the output lines 69-1 through 69-4. The net result is that frequency data word bits $F_5$ through $F_8$ appear as the output bits $G_1$ through $G_4$ representing a right shift of four bit positions.

If $O_1 = 0$, $O_2 = 0$, and $O_3 = 1$, a net right shift of three places occurs. A shift of one place is introduced by the logic 61 and an additional shift of two places in introduced by the logic 62. No shift occurs in the logic 63. In this fashion, the octave data $O_1$, $O_2$, $O_3$ contained in the data stored in Assignment Memory 13, FIG. 3, is used to divide the frequency data words to correspond to the note within the designated octave.

FIG. 4 illustrates the use of a right shift logic for an implementation of Octave Divider 60, FIG. 3, when the frequency data words are read in parallel form from Frequency Number Table 18. When such data words are read out in serial form, there are well-known techniques and circuits known to those skilled in the art of digital logic design to perform bit delays which effectuate divisions of the input data words.

Figure 5A:
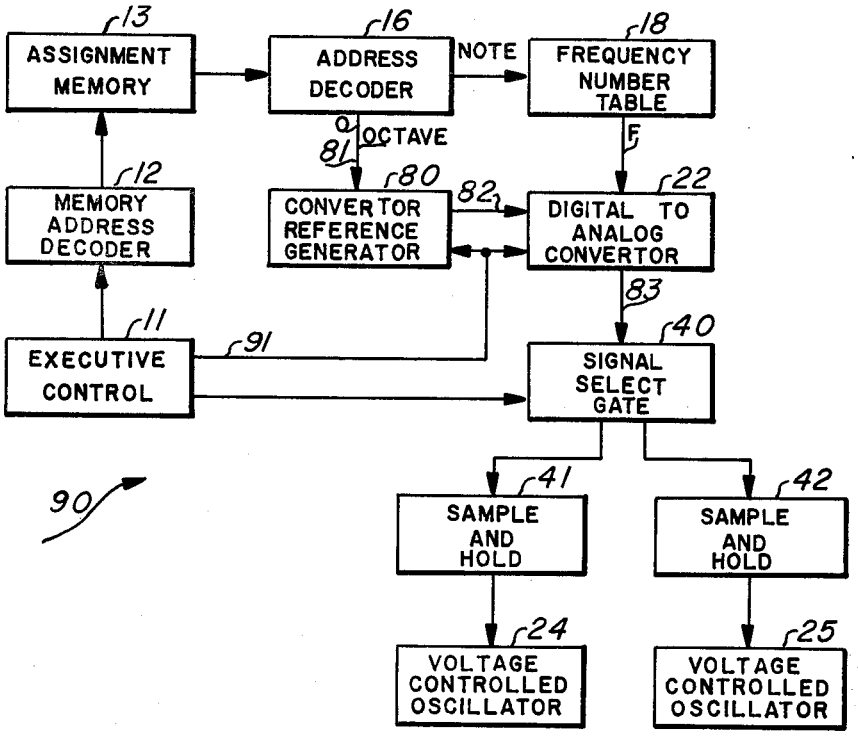
FIG. 5*a* illustrates a block diagram in which octave division is accomplished in the analog signal channel.
Figure 5B:
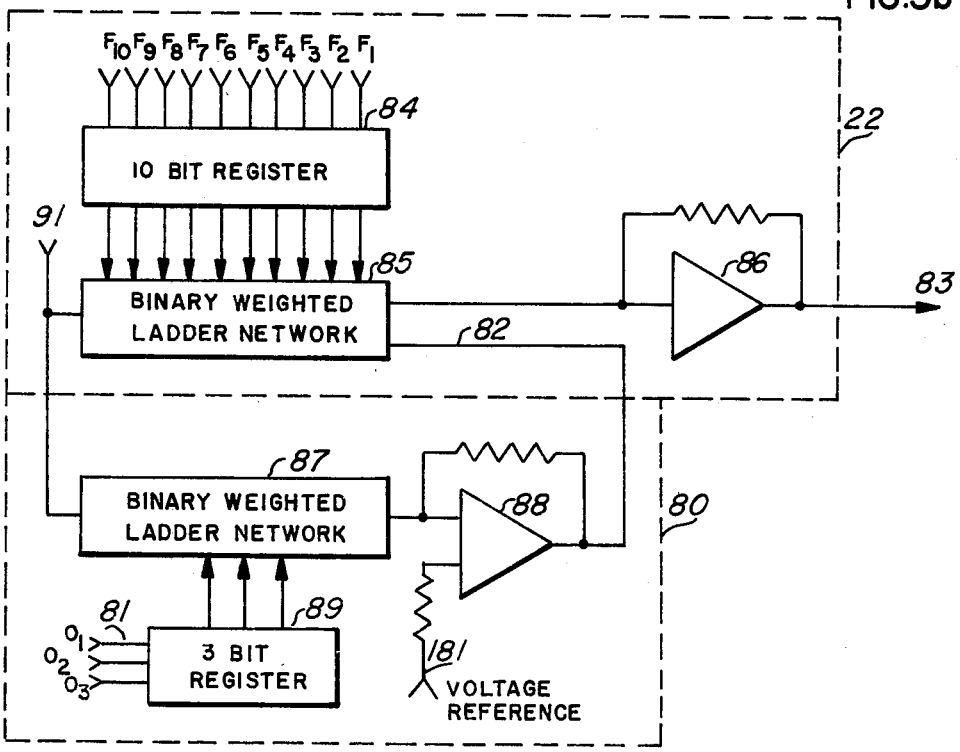
FIG. 5*b* is a logic diagram illustrating octave division applied to the reference voltage of a digital to analog convertor.

In FIG. 5*a* and FIG. 5*b*, an alternate system 90 is shown as a means for obtaining the full keyboard range of analog frequency control voltages when only 13 frequency data words are stored in Frequency Number Table 18. System 90 employs a version of a multiplying digital-to-analog convertor for performing the octave divisions of the frequency control voltage. FIG. 5*b* shows the logic components associated with system logic blocks Digital to Analog Convertor 22 and Convertor Reference Generator 80. Digital to Analog Convertor 22 is shown for frequency data words F consisting of 10 bit words, $F_1$ through $F_{10}$. The frequency data words are stored temporarily in a 10 bit Register 84. In response to a conversion control furnished by Executive Logic 11 via line 91, the contents of Register 84 actuate switches in the Binary Weighted Ladder Network 85. In this manner, the bits $F_1$ through $F_{10}$ cause corresponding fractions of the reference voltage on line 82 to be transferred to Operational Amplifier 86 which in turn transfers these fractional analog frequency control voltages to line 83. Digital to Analog Convertor 22 is also called a frequency word convertor. Address Decoder 16 detects and transfers the octave bits via line 81 for each note being addressed from Frequency Number Table 18. The octave bits consist of bits $O_1$ through $O_3$ and are shown in FIG. 5*b* entering into Convertor Reference Generator 80 on line 81. These bits are stored temporarily in Register 89. In response to the control signal entering via line 91, the contents of Register 89 actuate switches in the Binary Weighted Ladder Network 87. In this manner, octave bits $O_1$ through $O_3$ cause corresponding fractions of the voltage reference 181 to be applied as a reference voltage via line 82 to Digital to Analog Convertor 22. Convertor Reference Generator 80 is also called an octave data word digital to analog convertor. Table 3 illustrates the octave bit coding used by Register 89 in conjunction with Ladder Network 87 to obtain the divisions of the reference voltage furnished on line 82 for each octave of an organ's keyboard.

Figure 6:
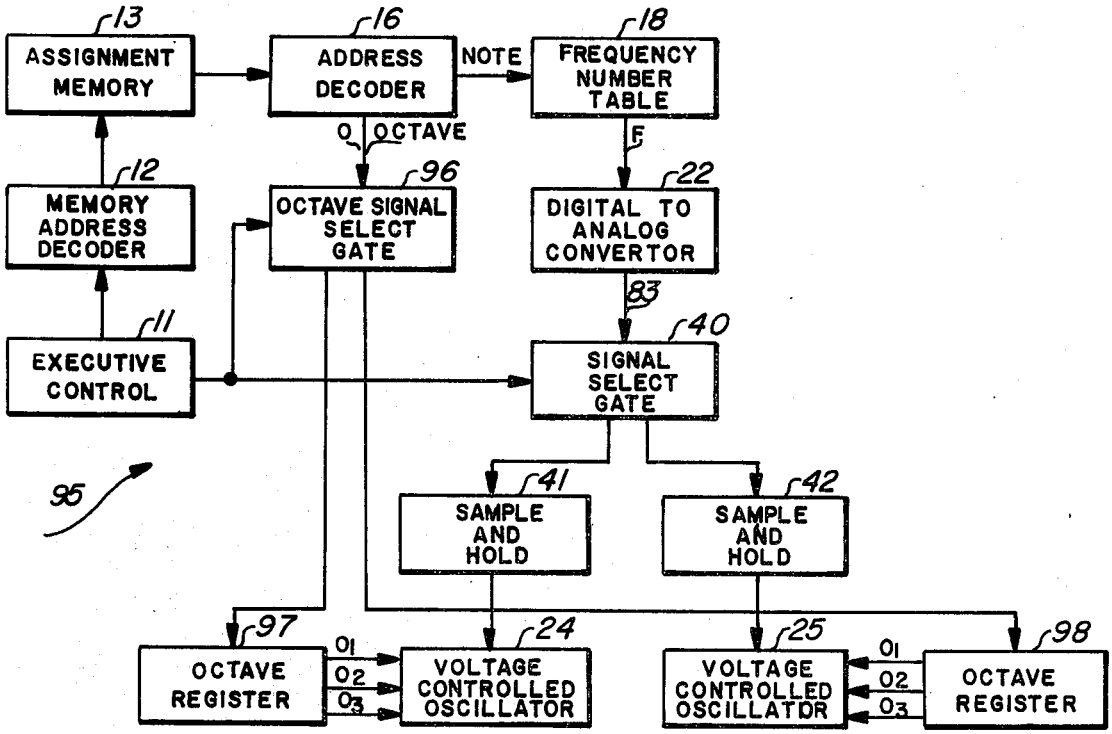
FIG. 6 is a block diagram showing the use of octave data to switch sets of frequency determining circuit elements in voltage controlled oscillators.

FIG. 6 illustrates an alternative system 95 to obtain full keyboard coverage with a table of 12 frequency numbers corresponding to the upper range notes $C\#_6$, $D_6$, $D\#_6$, $E_6$, $F_6$, $F\#_6$, $G_6$, $G\#_6$, $A_6$, $A\#_6$, $B_6$, $C_7$. System 95 is particularly advantageous for use with voltage controlled oscillators which do not have sufficient voltage-frequency linearity to adequately cover the musical frequency range of $C_2 = 63.4$hz to $C_7 = 2093$hz with sufficient accuracy for a musical instrument. A common expedient used in musical synthesizers is to design the voltage controlled oscillator to accurately cover a single octave with a set of given values of the frequency determining elements. One such set of frequency determining elements is available for each corresponding octave of the instrument's keyboard. Each keyboard switch causes a control voltage to be furnished to the voltage controlled oscillator corresponding to the note within an octave and simultaneously an octave switch causes the corresponding frequency determining elements to be actuated for the particular octave actuated on the keyboard.

TABLE 3

| OCTAVE | CODE $0_1\,0_2\,0_3$ | REFERENCE VOLTAGE DIVISION |
|---|---|---|
| 6 | 1 1 1 | 1 |
| 5 | 0 1 1 | 2 |
| 4 | 1 0 1 | 4 |
| 3 | 0 0 1 | 8 |
| 2 | 1 1 0 | 16 |

In FIG. 6, Voltage Controlled Oscillators 24 and 25 each contain sets of frequency determining elements corresponding to each octave of the organ's keyboard. Address Decoder 16 furnishes octave data O to octave Signal Select Gate 96 for each note it addresses from Frequency Number Table 18. Executive Control 11 causes Octave Signal Select Gate 96 to direct the octave data O to either Octave Register 97 or Octave Register 98 corresponding to a similar data selection performed by Signal Select Gate 40. The octave data O contained in each Octave Register, 97 and 98, is used to select frequency determining elements associated with each octave and contained within each voltage controlled oscillator, 24 and 25.

Figure 7:
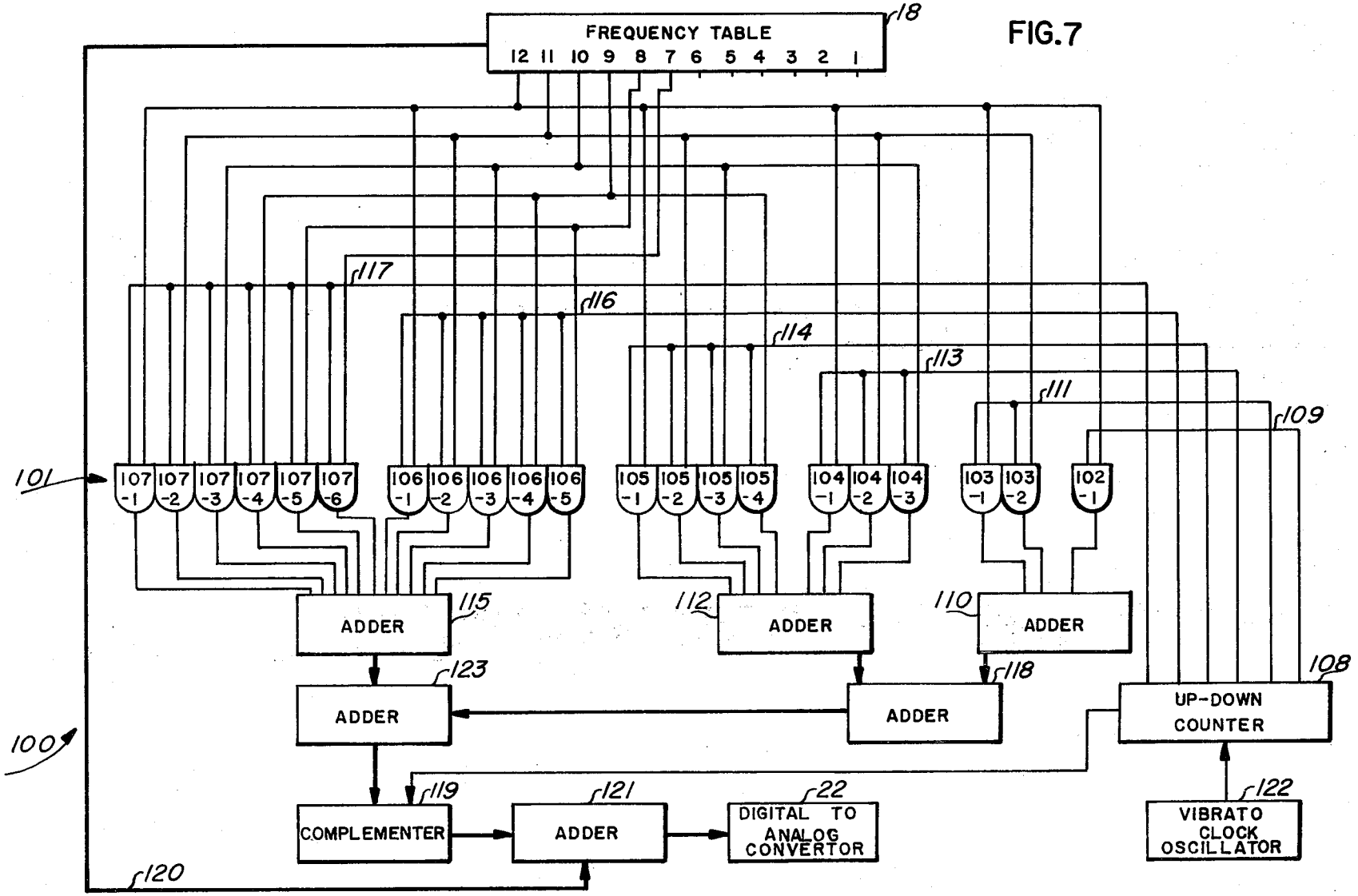
FIG. 7 is a logic diagram illustrating means for introducing vibrato on frequency data numbers.

Subsystem 100 illustrated in FIG. 7 shows a means for introducing vibrato as a frequency modulation of the frequency of the voltage controlled oscillators. The frequency modulation is produced directly from the frequency data words stored in Frequency Table 18. The frequency data words are divided as they are read from the table and the result is added to (or subtracted from) the original word. Let F denote the frequency data word, then after division by some power of 2, the new frequency data word is $$F' = F \pm F/2^k = F(2^k \pm 1)/2^k. \quad (1)$$

The corresponding frequency deviation as measured in cents is $$\text{cents} = c_k \log_{10} F'/F = c_k \log_{10}(2^k \pm 1)/2^k. \quad (2)$$

where $$c_k = 1200/\log_{10}2 = 3986.3. \quad (3)$$

Intermediate values of frequency deviation can be obtained by adding sets of frequency numbers that have been divided by different powers of 2.

The logic 101 consists of six sets of AND gates which are controlled by means of binary coded signals generated by Up-Down Counter 108. AND gate 102-1, when a one signal appears of line 109, causes the 12th bit of the frequency data word addressed from Frequency Table 18 to be transferred as an input to Adder 110. For illustration purposes, Frequency Table 18 is described for frequency data words consisting of 12 bits. Bit number 1 is the LSB. When a one signal appears of line 111, the AND gates 103-1 and 103-2 cause the 12th and 11th bits of an addressed frequency data word to be transferred as an input to Adder 110. Gates 103-1 and 103-2 effect a division of 1024 on the frequency data word while AND gate 102-1 causes a division of 2048.

The set of AND gates 104-1 through 104-3 cause a division of 512 of the frequency data word transferred to Adder 112 under control of the signal on line 113. The set of AND gates 105-1 through 105-4 cause a division of 256 of the frequency data word transferred to Adder 112 under control of the signal on line 114.

The set of AND gates 106-1 through 106-5 cause a division of 128 of the frequency data word transferred to Adder 115 under control of the signal on line 116. The set of AND gates 107-1 through 107-6 cause a division of 64 of the frequency data word transferred to Adder 115 under control of the signal on line 117.

The output data from Adder 110 and Adder 112 are summed in Adder 118. The output data from Adder 118 and Adder 115 are summed in Adder 123. The tree of adders permits the addition of all possible combinations of the set of frequency data word dividers consisting of the logic 101. The sum data word from Adder 123 is complemented (2's complement is the preferred embodiment of the binary number system) by Complementer 119 under control of the signal on line 120 created by Up-Down Counter 108. The control signal causes Complementer 119 to transfer its input data to Adder 121 with no alteration when Up-Down Counter 108 is increasing its count. When Up-Down Counter 108 is decreasing its count, the control signal is changed so that Complementer 119 performs a 2's complement of the data received from Adder 123 before such data is transferred to Adder 121.

Adder 121 performs the sum of the frequency data word addressed from Frequency Table 18 and the positive, or negative, fraction of the same fequency data word as controlled by Up-Down Counter 108. The output of Adder 121 is converted to an analog frequency control voltage by Digital to Analog Convertor 22.

The vibrato rate is controlled by the frequency of Vibrato Clock Oscillator 122. The depth of the vibrato is controlled by the number of steps, or equivalently, the count performed by Up-Down Counter 108. The greater the count, the larger will be the maximum frequency deviation, or the depth of the vibrato.

Additional sets of AND gates can be added to logic 101 to permit greater frequency deviations. By substituting other clock controls for Vibrato Clock Oscillator 122, the system 100 of FIG. 7 can be used to implement various frequency modulation effects such as glide, slalom, and portomento.

Figure 8:
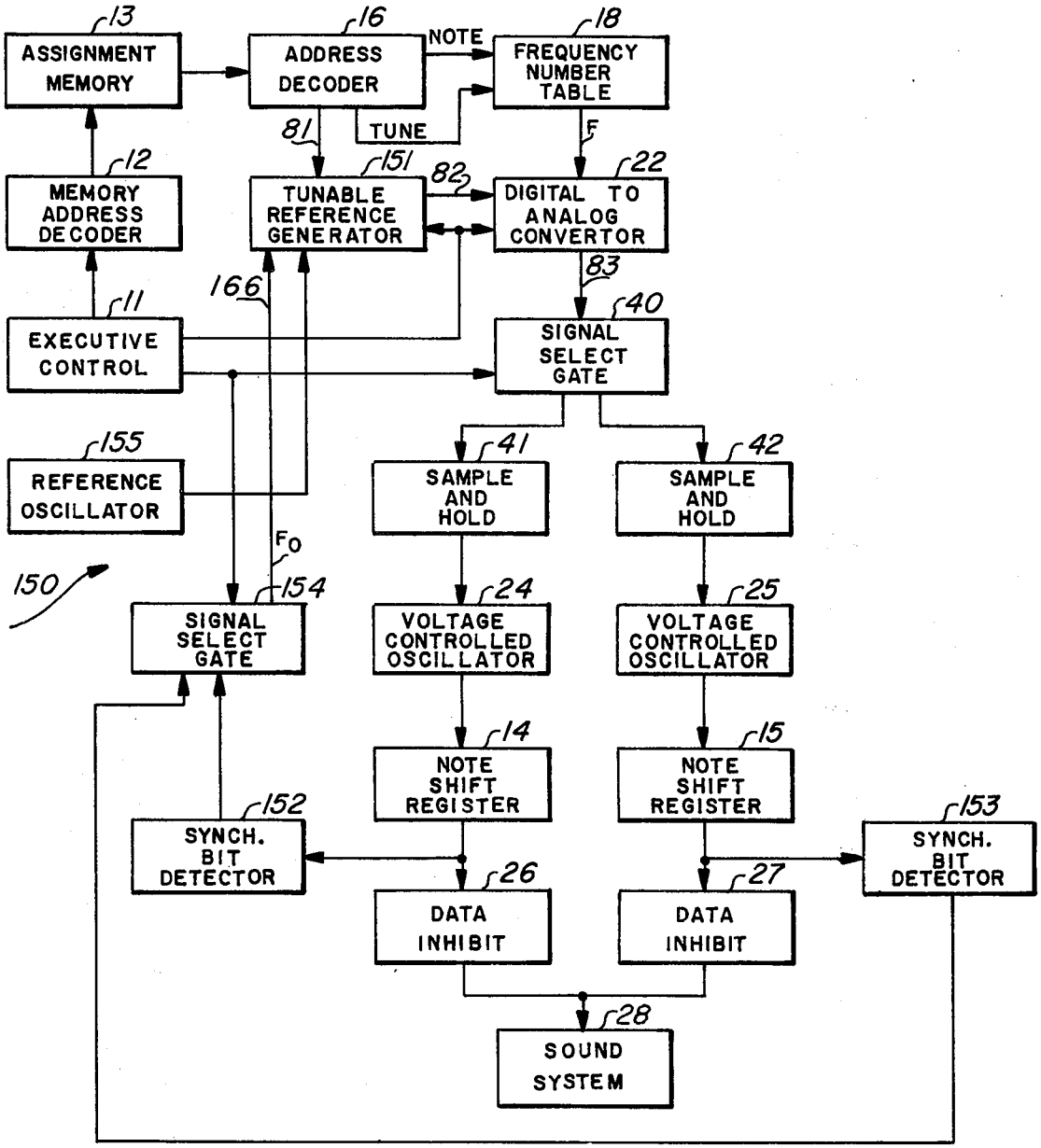
FIG. 8 shows the block diagram for automatic tuning.

System 150, shown in FIG. 8 includes means for repetitively adjusting the reference voltage for a Digital to Analog convertor so that the tuning of a voltage controlled oscillator is caused to be locked to that of a reference oscillator. The system is described as it is employed with a musical sound generation system such as that described in the copending application POLYPHONIC TONE SYNTHESIZER, Document Ser. No. 603,776. The same automatic tuning means can readily be incorporated into other systems in which the nominal frequency of a voltage controlled oscillator is desired to be determined by a reference clock or oscillator.

Figure 9A:
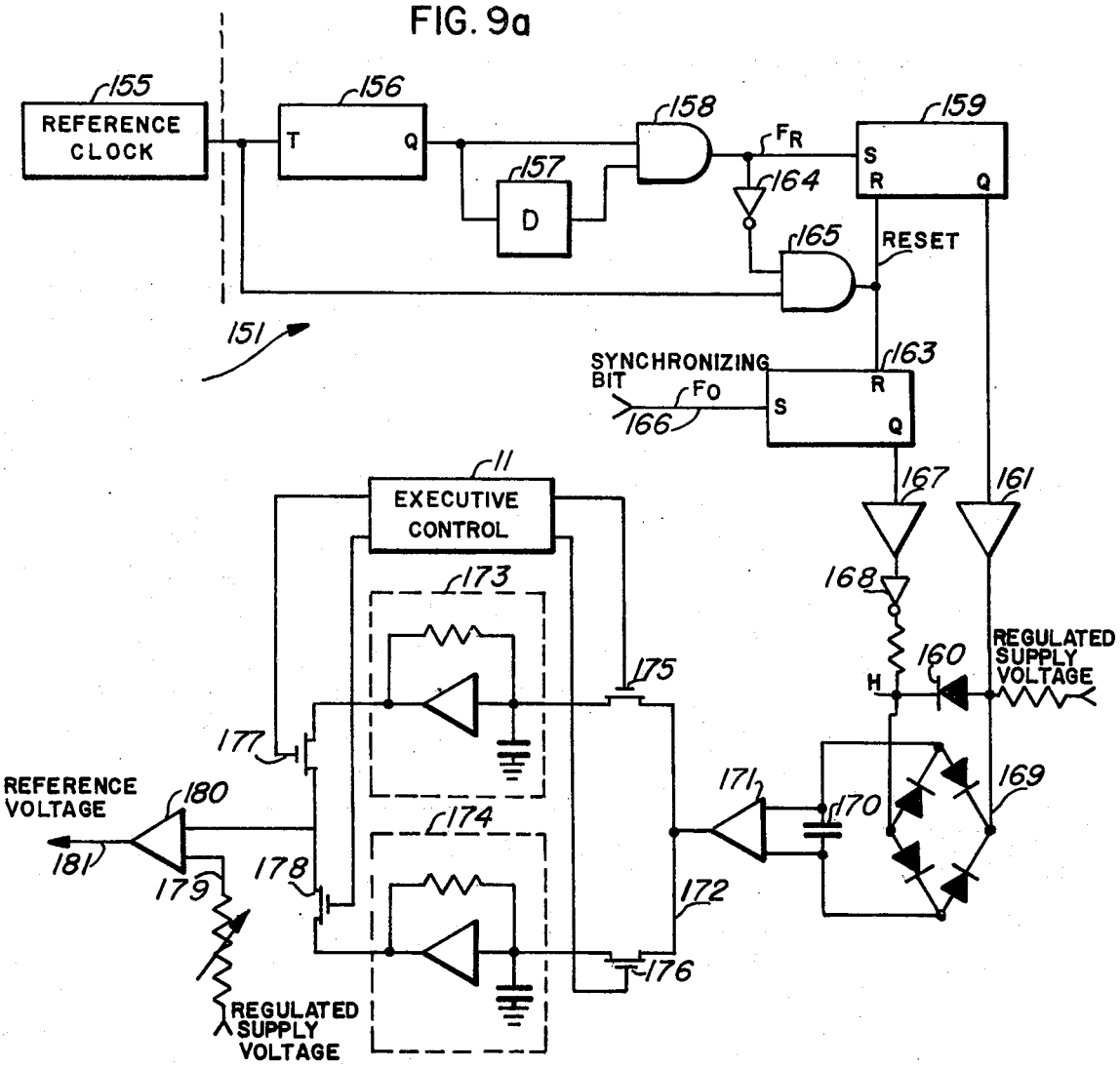
FIG. 9*a* shows the logic diagram for a phase discriminator used in automatic tuning system.

Address Decoder 16 causes a frequency data word F to be addressed from Frequency Number Table 18 and at the same time the corresponding octave data O is transferred via line 81 to Tunable Reference Generator 151. FIG. 9*a* shows the logic contained within Tunable Reference Generator 151. Digital to Analog Convertor 22 converts the binary digital frequency data word to an analog frequency control voltage. The analog frequency control voltage is directed via Signal Select Gate 40 to either Sample and Hold 41 or Sample and Hold 42 under control of a signal created and transmitted by Executive Control 11. The frequency control voltages stored in the sample and hold subsystems cause Voltage Controlled Oscillator 24 and Voltage Controlled Oscillator 25 to operate at clock frequencies that are N times that of the fundamental frequency of the note actuated on the keyboard. The number N is a design parameter of the Polyphonic Tone Synthesizer and is advantageously selected as N = 64 for the generation of music tones containing up to 32 harmonics.

Each Voltage Controlled Oscillator, 24 and 25, acts as a clock to read stored data from their associated Note Shift Registers, 14 and 15. Associated with the data stored in the Note Shift Registers is a synchronizing bit which occurs once per period of the generated musical waveshape and as such can be used by System 150 as a measure of the generated musical fundamental frequency induced by the corresponding Voltage Controlled Oscillator.

The synchronizing bits contained in the Note Shift Registers, 14 and 15, are detected by Synch. Bit Detector 152 and Synch. Bit Detector 153. One of these synchronizing bits is selected by means of Select Signal Gate 154 under control of Executive Logic 11 and is transmitted to Tunable Reference Generator 151.

The tuning of the Voltage Controlled Oscillators is accomplished within Tunable Reference Generator 151 by adjusting the reference voltage used by Digital to Analog Convertor 22. The tuning is always done at a fixed frequency corresponding to that of Reference Oscillator 155. The tuning adjustment is made to a reference voltage to be used by Digital to Analog Convertor 22 which is associated with each of the individual Voltage Controlled Oscillators. Tuning is always accomplished during time slots determined by Executive Control 11 and the procedure is only enabled when Address Decoder 16 detects that a word stored in Assignment Memory 13 is currently unassigned. The detection of an unassigned word causes the following subsystem functions: (a) A special frequency data word is addressed from Frequency Number Table 18 in response to TUNE signal transmitted by Address Decoder 16. The special frequency data word corresponds to the frequency of Reference Oscillator 155. Advantageously it is the frequency corresponding to note $A_6 = 1760$hz. (b) The Data Inhibit, 26 or 27, is caused to inhibit data read from the Note Shift Register in the channel being tuned from reaching Sound System 28.

The logic elements of system 150 logic block Tunable Reference Generator 151 are shown in FIG. 9*a*. The signals received from Reference Clock 155 are frequency divided by a factor of two by means of flip-flop 156. The reference clock signal $F_R$ is obtained from the output of flip-flop 156 by creating a pulse corresponding to the positive rise of the output by means of the combination consisting of Delay 157 and AND gate 158.

Clock pulses $F_R$ cause flip-flop 159 to set. The output Q of flip-flop 159 is transmitted to diode 160 by means of operational amplifier 161. (All operational amplifiers shown in FIG. 9*a* are non-inverting.)

The Reset signal for flip-flop 159 and flip-flop 163 are obtained from reference clock 155 by means of Invertor 164 and AND gate 165. In this manner every second clock pulse from Reference Clock 155 generates the Reset signal and the purpose of AND gate 165 is to select the Reset as that signal which is not the signal used to generate clock pulses $F_R$.

The synchronizing bit, entering on line 166, corresponding to frequency $F_O$, is used to set flip-flop 163. The output Q of flip-flop 163 is transmitted to diode 160 by Amplifier 167 and Invertor 168.

Figure 9B:
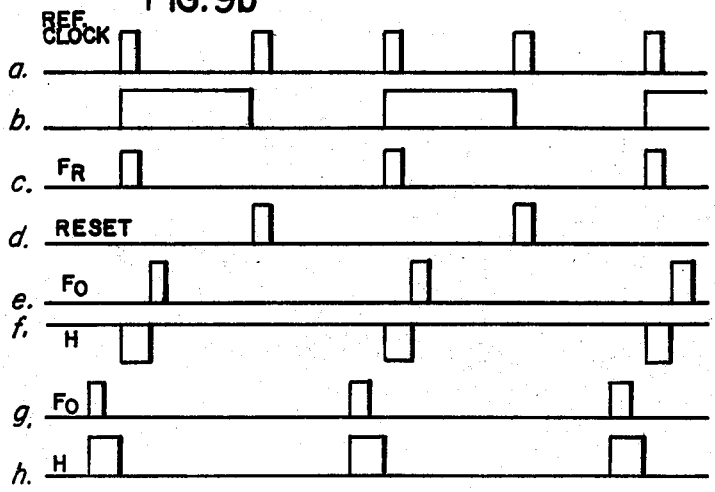
FIG. 9*b* illustrates timing signals in phase discriminator.

The pulse train generated across diode 160 can consist of pulses of either polarity. The polarity is determined by the relative phases of clock pulse trains $F_R$ and $F_O$. FIG. 9*b* illustrates typical pulse trains that can be generated across diode 160. Curve *a.* shows the pulse train generated by Reference Clock 155. Curve *b.* is the square wave output Q of flip-flop 156. Curve *c.* is the pulse train $F_R$ created by the edge detector combination of Delay 157 and AND gate 158. Curve *d.* shows the RESET signal which corresponds to every second pulse of Reference Clock 155. Curve *e.* illustrates the case in which $F_O$ is nearly at the frequency of $F_R$ but is delayed. This case produces the waveshape of curve *f.* at point H. If on the otherhand $F_O$ is nearly at the frequency of $F_R$ but is advanced in phase, as in curve *g.*, then curve *h.* shows that a positive train of pulses appears at H.

The width of the pulse trains at H is a measure of the relative phase difference between $F_R$ and $F_O$ while the polarity is an indication of either lagging or leading phase.

Figure 9C:
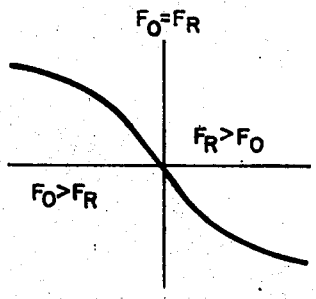
FIG. 9*c* shows phase discriminator characteristic curve.

The signal across diode 160 is full-wave rectified by the diode bridge 169 and smoothed by the combination of capacitor 170 and Amplifier 171. FIG. 9*c* illustrates the resultant voltage on line 172. This is the familiar curve for a phase discriminator.

Executive Control 11 causes the signal on line 172 to be applied to either Sample and Hold 173 or Sample and Hold 174 by applying control signals to MOS FET signal gates 175 and 176. In this manner a Sample and Hold circuit contains the frequency correction voltage for each of the individual Voltage Controlled Oscillators, 24 and 25. The system is initially placed within range of the automatic tuning means by adjusting the regulated supply voltage by means of the variable control 179. The output voltage from Amplifier 180 is applied as Voltage Reference 181 shown in FIG. 5*b*. Each Sample and Hold, 173 and 174, is connected to furnish an additive correction signal to Amplifier 180 by means of the MOS FET signal gates 177 and 178 which are actuated by Executive Control 11. The correction voltages are added in such polarity that the individual Voltage Controlled Oscillators are caused to lock onto the frequency of Reference Oscillator 155.

There are a wide variety of control conditions that can be used in conjunction with System 150 of FIG. 8. For example, when the musical instrument has power initially applied, Executive Control can immediately tune each Voltage Controlled Oscillator in turn. In ordinary play of the instrument there are many instants in which one or more of the Voltage Controlled Oscillators is unassigned. During such nonassigned times, Executive Control can initiate the automatic tuning for all such unassigned oscillators. Because of the voltage memory inherent in Sample and Hold 173 and 174 (FIG. 9*a*), only occasional tuning cycles are required to maintain sufficient tuning accuracy.

The entire set of Voltage Controlled Oscillators can be tuned to the frequency of other musical instruments by tuning only Reference Oscillator 155. The automatic tuning function of System 150 causes all the Voltage Controlled Oscillators to change their nominal frequencies as demanded by the change in the frequency of Reference Oscillator 155.

An obvious modification of the logic shown in FIG. 9*a* is to use a frequency discriminator to replace the phase discriminator which was previously described.

While the various features of the subject invention are illustrated for two Voltage Controlled Oscillators, this is not an inherent limitation and any number of such oscillators can be used by obvious modification of the signal channels. Advantageously the number of Voltage Controlled Oscillators in equal to the number of data words contained in Assignment Memory 13.

The use of an Executive Control logic to time various subsystem logic functions was described as illustrative of the utilization of the subject invention in conjunction with KEYBOARD SWITCH DETECT AND ASSIGNOR (Doc. Ser. No. 619,615) as used with the POLYPHONIC TONE SYNTHESIZER (Document Ser. No. 603,776). An immediate extension of the subject invention to a wide variety of other system applications is to extend the data word contained in the Assignment Memory 13 (i.e. FIG. 1) so that such data words contain the address of a member of the set of voltage controlled oscillators. These address bits can then be used in a straightforward fashion to operate the various signal select gates and as such replace the signals furnished in the preceding illustrative subsystems by the Executive Control system logic block.

Intending to claim all novel, useful and unobvious features shown or described, the applicants make the following claims:

1. In an electronic musical instrument of a type wherein the tone generator utilizes a plurality of voltage controlled oscillators, the fundamental frequency of the generated tones being proportional to analog frequency control voltages applied to said oscillators, the improvement comprising;

assignment memory means for writing assignment data to be thereafter read out, decoding means responsive to said assignment data read out from said assignment memory means, memory means for storing frequency data words, addressing means responsive to said decoding means whereby said frequency data words are caused to be read from said memory means, conversion means whereby data read out from said memory means is converted into analog frequency control voltages, oscillator means responsive to said analog frequency control voltages whereby oscillator frequencies are caused to vary frequency responsive to analog frequency control voltages, and inhibit means responsive to said decoding means whereby in response to said assignment data output signals from said electronic musical instrument is inhibited for unassigned oscillator means.

2. In an electronic musical instrument according to claim 1 wherein said memory means further comprises;

a memory comprising twelve said frequency data words corresponding to the frequencies of an equal tempered musical scale, means for causing members of frequency data words to be read out from said memory in response to said addressing means, means for dividing said frequency data words read out from said memory by factors $2^{(6-M)}$, where M corresponds to an octave number of the musical instrument's keyboard, and addressing means responsive to said decoding means further comprising means for decoding octave data from said assignment data read out from said assignment memory means whereby said number M is supplied to said means for dividing.

3. In an electronic musical instrument according to claim 1 wherein said memory further comprises;

a memory containing a plurality of said frequency data words wherein frequency data words correspond to plurality of said oscillator frequencies, means for causing members of plurality of said frequency data words to be read out from said memory in response to said addressing means;

data scaling means wherein frequency data words read from memory are multiplied by scale factors $K_j$, where $j = 1,2,\ldots,Q$ are scaling selection numbers which cause selection of corresponding values of scale factor $K_j$, control circuitry means wherein said scaling selection numbers are created, complementor responsive to said control circuitry means whereby said frequency data words multiplied by scale factors $K_j$ in data scaling means are complemented, and adder wherein said frequency data words read out from said memory in response to said addressing means are added to data words furnished by said complementor.

4. In an electronic musical instrument according to claim 1 wherein said memory means further comprises;

a memory containing a plurality of said frequency data words, wherein frequency data words correspond to plurality of said oscillator frequencies, and means for causing members of plurality of said frequency data words to be read out from said memory in response to said addressing means.

5. In an electronic musical instrument according to claim 4 wherein said conversion means further comprises;

a digital to analog convertor responsive to said frequency data words read from said second memory means whereby analog frequency control voltages are generated in response to frequency data words, a plurality of analog memories wherein said analog frequency control voltages are stored to be thereafter read out, signal select means responsive to said decoding means whereby said assignment data causes said analog frequency control voltages to be stored in corresponding members of said plurality of analog memories, and a plurality of buffer amplifiers each corresponding to a member of said plurality of analog memories whereby said stored analog frequency control voltages can be read out from said analog memories without alteration.

6. In an electronic musical instrument according to claim 4 wherein said memory means further comprises;

a second memory means comprising a plurality of memories for writing data to be thereafter read out.

7. In an electronic musical instrument according to claim 6 wherein said conversion means further comprises;

a plurality of digital to analog convertors each member of such plurality of convertors being responsive to said frequency data words read from corresponding member of said plurality of memories, and whereby analog frequency control voltages are generated in response to said frequency data words, and a plurality of analog memories each corresponding to a member of said plurality of digital to analog convertors wherein said analog frequency control voltages are stored to be thereafter read out, and a plurality of buffer amplifiers each corresponding to a member of said plurality of analog memories whereby said stored analog control voltages can be read out from said analog memories without alteration.

8. In an electronic musical instrument according to claim 1 wherein said oscillator means further comprises;

a plurality of voltage controlled oscillators wherein frequencies of such oscillators are responsive to said analog control voltages.

9. In an electronic musical instrument according to claim 1 wherein said memory means further comprises;

a memory comprising twelve said frequency data words corresponding to the frequencies of an equal tempered musical scale, addressing means responsive to said decoding means further comprising means for decoding octave data from said assignment data read out from said assignment memory means whereby a number M is created corresponding to an octave number of the musical instrument's keyboard, conversion means further comprising a frequency data word digital to analog convertor responsive to said frequency data words caused to be read from said memory by said addressing means and wherein analog frequency control voltages are generated in response to frequency data words; and an octave data word digital to analog convertor responsive to said number M wherein an octave reference control voltage $V = A2^{(6-M)}$ is created, where A is a constant scale factor;

circuitry means wherein said octave reference control voltage is utilized as a voltage reference for said frequency data word digital to analog convertor, a plurality of analog memories wherein said analog frequency control voltages are stored to be thereafter read out, signal select means responsive to said decoding means whereby said assignment data causes said analog frequency control voltages to be stored in corresponding members of said plurality of analog memories, and a plurality of buffer amplifiers, each corresponding to a member of said plurality of analog memories, whereby said stored analog frequency control voltages can be read out from said analog memories without alteration.

10. In an electronic musical instrument according to claim 9 wherein said oscillator means further comprises;

a plurality of voltage controlled oscillators wherein frequencies of such oscillators are responsive to said analog voltages read out from said analog memories, a plurality of frequency determining circuitry means associated with each member of said plurality of voltage controlled oscillators wherein each member of plurality of frequency determining circuitry comprises means for causing corresponding member of plurality of voltage controlled oscillators to generate frequencies within a musical osctave, and switching circuitry means responsive to said number M wherein members of said plurality of frequency determining circuitry means are caused to be selected thereby establishing octave frequency ranges for each assigned member of said plurality of voltage controlled oscillators.

11. In an electronic musical instrument according to claim 1 wherein said oscillator means further comprises;

a plurality of voltage controlled oscillators wherein frequencies of such oscillators are responsive to said analog frequency control voltages, a plurality of clock generating means, each member of which is associated with a corresponding member of said plurality of voltage controlled oscillators, wherein in response to frequency signals $F_O$ created by members of plurality of voltage controlled oscillators a clock signal is generated at a frequency $DF_O$, where D is a scale factor, a reference clock generator wherein a reference clock signal is created at frequency $F_R$, signal select gate responsive to tuning select control signals wherein a selection is made from plurality of clock signals generated by said plurality of clock generating means, comparator means wherein said clock signal selected by said signal select gate is compared with said reference clock signal and wherein an error signal is created when said compared signals differ, a plurality of analog error memories, each member of which is associated with a corresponding member of said plurality of voltage controlled oscillators, wherein said error signals are stored to be thereafter read out, plurality of first error memory selection gates wherein said error signals are caused to be stored in members of said plurality of analog error memories and wherein selection of members of analog error memories is responsive to said tuning select control signals, tuning timing means wherein said tuning select control signals and tuning select read out signals are created repetitively for said plurality of voltage controlled oscillators and wherein tuning select control signals and tuning select read out signals are not created for corresponding members of plurality of voltage controlled oscillators that are in their assigned states, conversion means further comprising plurality of second error memory selection gates wherein error signals stored in said plurality of analog error memories are read out responsive to said tuning select read out signals, a plurality of reference voltages each such voltage corresponding to a member of said plurality of voltage controlled oscillators, voltage adding means whereby error signals caused to be read out of analog error memories are added with corresponding reference voltages, inhibit means further comprising circuitry whereby output signals from said electronic musical instrument are inhibited for tone generator corresponding to member of plurality of voltage controlled oscillators selected by said tuning select control signal, memory means further comprising a stored tuning frequency data word, and addressing means further comprising circuitry responsive to said tuning select control signals whereby said tuning frequency data word is caused to be read out from said memory means.

12. In an electronic musical instrument according to claim 11 wherein said comparator means further comprises;

a phase comparison means wherein an error signal of one polarity is created when said reference clock frequency $F_R$ leads the phase of said clock signal $DF_O$, wherein an error signal of the opposite polarity is created when reference clock frequency $F_R$ lags the phase of clock signal $DF_O$, wherein a zero error signal is created when reference clock frequency $F_R$ is in phase with clock signal $DF_O$, and wherein said error signal is proportional to the magnitude of phase difference between signal frequencies $F_R$ and $DF_O$.

13. In an electronic musical instrument according to claim 11 wherein said comparator means further comprises;

a frequency comparison means wherein an error signal of one polarity is created when said reference clock frequency $F_R$ is higher than said clock signal frequency $DF_O$, wherein an error signal of the opposite polarity is created when reference clock frequency $F_R$ is lower than clock signal frequency $DF_O$, wherein a zero error signal is created when reference clock frequency $F_R$ is equal to clock signal frequency $DF_O$, and wherein said error signal is proportional to the magnitude of the frequency difference between signal frequencies $F_R$ and $DF_O$.

14. In an electronic musical instrument according to claim 11 wherein said reference clock generator further comprises;

a means for tuning wherein a variable frequency clock generator is used to create reference clock signal $F_R$ thereby causing tuning of said electronic musical instrument.

15. In an electronic musical instrument according to claim 1 wherein said memory means further comprises;

a memory comprising twelve said frequency data words corresponding to the frequencies of an equal tempered musical scale, addressing means responsive to said decoding means further comprising means for decoding octave data from said assignment data read out from said assignment memory means whereby a number M is created corresponding to an octave number of the musical instrument's keyboard, and oscillator means further comprising a plurality of voltage controlled oscillators wherein frequencies of such oscillators are responsive to said analog frequency control voltages; a plurality of frequency determining circuitry means associated with each member of said plurality of voltage controlled oscillators wherein each member of plurality of frequency determining circuitry comprises means for causing corresponding member of plurality of voltage controlled oscillators to generate frequencies within a musical octave: and switching circuitry means responsive to said number M wherein members of said plurality of frequency determining circuitry means are caused to be selected thereby establishing octave frequency ranges for each assigned member of said plurality of voltage controlled oscillators.

16. In a system utilizing frequency modulated clock signals generated by voltage controlled oscillators, the instantaneous frequency of the generated clock signals being proportional to analog control voltages, the improvement comprising;

memory means for storing frequency data words, an oscillator means comprising a plurality of voltage controlled oscillators wherein the frequencies of such oscillators are responsive to analog frequency control voltages, assignment means wherein control signals are generated whereby said analog frequency control voltages are assigned to members of said plurality of voltage controlled oscillators, addressing means responsive to said assignment means whereby said frequency data words are read out from said memory means, conversion means wherein said frequency data words read out from said memory means are converted to said analog frequency control voltages, signal selection means responsive to said assignment means whereby said analog frequency control voltages are selectively directed to members of said plurality of voltage controlled oscillators, and signal adding means wherein analog voltages are added to said analog frequency control voltages thereby generating frequency modulation.

17. In a system utilizing clock signals generated by voltage controlled oscillators, the frequency of the generated clock signals being proportional to analog control voltages, the improvement comprising;

memory means for storing frequency data words and a tuning frequency data word, a plurality of voltage controlled oscillators wherein frequencies of such oscillators are responsive to said analog frequency control voltages, assignment means wherein control signals are generated whereby said analog frequency control voltages are assigned to members of said plurality of voltage controlled oscillators, addressing means responsive to said assignment means whereby said frequency data words are read out from said memory means and whereby said tuning frequency data word is caused to be read out from said memory means, a plurality of clock generating means, each member of which is associated with a corresponding member of said plurality of voltage controlled oscillators, wherein in response to frequency signals $F_O$ created by members of plurality of voltage controlled oscillators clock signals are generated at a frequency $DF_O$, where D is a scale factor, a reference clock generator wherein a reference clock signal is created at a frequency $F_R$, a signal select gate responsive to tuning select control signals wherein a selection is made from plurality of clock signals generated by said plurality of clock generating means, comparator means wherein said clock signal selected by said signal select gate is compared with said reference clock signal and wherein an error signal is created when said compared signals differ, a plurality of analog error memories, each member of which is associated with a corresponding member of said plurality of voltage controlled oscillators, and wherein selection of a member of said plurality of analog error memories is responsive to said tuning select control signals, tuning timing means wherein said tuning select control signals and tuning select read out signals are created repetitively for said plurality of voltage controlled oscillators and wherein tuning select control signals and tuning select read out signals are not created for corresponding members of plurality of voltage controlled oscillators that are in their assigned states, and conversion means wherein said frequency data words read out from said memory means are converted to said analog frequency control voltages; and further comprising a plurality of second error memory selection gates wherein said error signals stored in said plurality of analog error memories are read out responsive to said tuning select read out signals, a plurality of reference voltage controlled oscillators, voltage adding means whereby error signals caused to be read out of members of said analog error memories are added with corresponding members of said reference voltages.

18. In a system utilizing clock signals generated by voltage controlled oscillators according to claim 17 wherein said comparator means further comprises;

a phase comparison means wherein an error signal of one polarity is created when said reference clock frequency $F_R$ leads the phase of said clock signal $DF_O$, wherein an error signal of the opposite polarity is created when reference clock frequency $F_R$ lags the phase of clock signal $DF_O$, wherein a zero error signal is created when reference clock frequency $F_R$ is in phase with clock signal $DF_O$, and wherein said error signal is proportional to the magnitude of phase difference between signal frequencies $F_R$ and $DF_O$.

19. In a system utilizing clock signals generated by voltage controlled oscillators according to claim 17 wherein said comparator means further comprises;

a frequency comparison means wherein an error signal of one polarity is created when said reference clock frequency $F_R$ is higher than said clock signal frequency $DF_O$, wherein an error signal of the opposite polarity is created when reference clock frequency $F_R$ is lower than clock signal frequency $DF_O$, wherein a zero error signal is created when reference clock frequency $F_R$ is equal to clock signal frequency $DF_O$, and wherein said error signal is proportional to the magnitude of the frequency difference between $F_R$ and $DF_O$.

* * * * *